US008573416B2

(12) United States Patent
Didehvar et al.

(10) Patent No.: US 8,573,416 B2
(45) Date of Patent: Nov. 5, 2013

(54) ADJUSTABLE SHELF ASSEMBLY

(75) Inventors: Keveh Didehvar, Hockessin, DE (US); Joseph Vaccaro, West Chester, PA (US)

(73) Assignee: Zenith Products Corporation, New Castle, DE (US)

( * ) Notice: Subject to any disclaimer, the term of this patent is extended or adjusted under 35 U.S.C. 154(b) by 0 days.

(21) Appl. No.: 12/903,399

(22) Filed: Oct. 13, 2010

(65) Prior Publication Data

US 2012/0091088 A1 Apr. 19, 2012

(51) Int. Cl.
*A47G 29/087* (2006.01)

(52) U.S. Cl.
USPC ..... 211/119.009

(58) Field of Classification Search
USPC ..... 211/85.12, 16, 71.01, 75, 85.29, 85.31, 211/88.02, 88.01, 90.02, 90.03, 94.01, 106, 211/119, 113, 119.009, 119.011, 126.15, 211/126.5, 126.9, 133.2, 133.3, 133.4, 211/133.5, 134, 151, 153, 162, 175, 181.1; 108/108, 102, 137, 143; 248/213.2, 248/214
See application file for complete search history.

(56) References Cited

U.S. PATENT DOCUMENTS 4,387,811 A * 6/1983 Ragir et al. ..... 211/119
4,541,131 A 9/1985 Sussman
4,884,702 A * 12/1989 Rekow ..... 211/90.02
D315,840 S * 4/1991 Emery ..... D6/525
5,031,783 A * 7/1991 Goudreau ..... 211/181.1
5,255,401 A 10/1993 Sambrookes et al.
5,272,991 A * 12/1993 Carrigan, Jr. ..... 108/108
D351,750 S * 10/1994 Sweeney ..... D6/525
5,429,252 A * 7/1995 Liu ..... 211/94.01
5,588,543 A 12/1996 Finger
5,622,010 A * 4/1997 Weber ..... 52/36.4
D396,157 S 7/1998 Hofman
5,775,521 A * 7/1998 Tisbo ..... 211/94.01
D397,567 S 9/1998 Hofman
6,109,462 A * 8/2000 Emalfarb et al. ..... 211/119
D446,670 S 8/2001 Emery et al.
6,520,351 B1 2/2003 Zadro
D473,411 S 4/2003 Walker
6,581,790 B1 6/2003 Zadro
D479,073 S 9/2003 Snell
D479,074 S 9/2003 Snell
D512,861 S 12/2005 Rosen
D530,948 S * 10/2006 Snell ..... D6/525
7,246,711 B1 * 7/2007 Metcalf ..... 211/175
D552,391 S 10/2007 Rosen
D552,393 S 10/2007 Rosen
D557,050 S 12/2007 Dretzka
D562,608 S 2/2008 Kramer (Continued)

*Primary Examiner* — Jonathan Liu
*Assistant Examiner* — Stanton L Krycinski
(74) *Attorney, Agent, or Firm* — Panitch Schwarze Belisario & Nadel LLP

(57) ABSTRACT

An adjustable shelf assembly including an elongated frame and a first shelf and a second shelf attached to the frame. The frame has a first end and a second end, and generally extends in a first plane. At least a portion of the first and second shelves extends in a second plane generally perpendicular to the first plane. The first and second shelves are separately transversely movable in the second plane relative to the frame. The shelf assembly is in an open position when the first and second shelves are transversely moved away and spaced apart from each other in the second plane, a generally vacant space is formed between the first and second shelves. The shelf assembly is in a closed position when the first and second shelves are positioned proximate to each other.

5 Claims, 8 Drawing Sheets

(56) References Cited

U.S. PATENT DOCUMENTS

| | | | | |
|---|---|---|---|---|
| D564,271 | S | 3/2008 | Snider | |
| D564,816 | S | 3/2008 | Snider | |
| D566,439 | S | 4/2008 | Dretzka | |
| D566,441 | S | 4/2008 | Dretzka | |
| D568,657 | S | 5/2008 | Snider | |
| D572,061 | S | 7/2008 | Snider | |
| D572,062 | S | 7/2008 | Snider | |
| D575,087 | S | 8/2008 | Ghiorghie | |
| D589,728 | S * | 4/2009 | Shaha et al. | D6/510 |
| 7,530,329 | B1 * | 5/2009 | Paris et al. | 119/61.57 |
| 7,571,822 | B2 | 8/2009 | Metcalf | |
| D615,333 | S | 5/2010 | Snell | |
| D617,128 | S | 6/2010 | Guindi | |
| 7,798,336 | B2 * | 9/2010 | Shiao | 211/70.6 |
| 7,806,283 | B2 * | 10/2010 | Metcalf | 211/175 |
| 2003/0132181 | A1 * | 7/2003 | Saulnier-Matteini | 211/153 |
| 2005/0039641 | A1 * | 2/2005 | Metcalf | 108/106 |
| 2006/0180561 | A1 * | 8/2006 | Wisnoski et al. | 211/94.01 |
| 2008/0000859 | A1 | 1/2008 | Yang et al. | |
| 2008/0035592 | A1 | 2/2008 | Yang et al. | |
| 2008/0302744 | A1 * | 12/2008 | Rosenberg | 211/94.01 |
| 2009/0188880 | A1 | 7/2009 | Yang et al. | |
| 2010/0102014 | A1 | 4/2010 | Yang | |
| 2010/0133218 | A1 * | 6/2010 | Yang et al. | 211/119.009 |

* cited by examiner

ADJUSTABLE SHELF ASSEMBLY

BACKGROUND OF THE INVENTION

The present invention relates to an adjustable shelf assembly, and more particularly, to an adjustable shelf assembly comprising a frame equipped with at least two shelves that are movable relative to the frame. The assembly may be used as a shower caddy because it is desirable to have an assembly capable of supporting a variety of bathing articles that a user generally requires when bathing or taking a shower. Numerous types of shower caddies have been developed to support such articles so that a person taking a shower can readily access such articles. One type of such conventional shower caddies includes caddies which are mounted over a shower head assembly.

A problem with such conventional shower caddies is that they are not always compatible with the layout of the shower and with the shower head assembly. For example, many shower head assemblies, such as handheld shower head assemblies, generally have a hose or flexible tube which generally rests against a shower wall. However, conventional shower caddies are often difficult to mount over handheld shower head assemblies because placement of the caddy is often obstructed by the flexible hose which lies below the base, or positioning of the hose is obstructed by the caddy. Specifically, difficulties arise because there is no space for the tube or hose of the handheld shower assembly to lay, as positioning of the tube or hose is impeded by the shower caddy.

Thus, it is desirable to provide an improved shower caddy configured to be mounted over a shower head assembly. More particularly, it is desirable to provide a shower caddy which is configured to be mounted over a shower head assembly and adjustable to accommodate the hose or tube portion of the shower head assembly.

BRIEF SUMMARY OF THE INVENTION

Briefly stated, the present invention is directed to an adjustable shelf assembly including an elongated frame, and a first shelf and a second shelf attached to the frame. The frame has a first end and a second end, and generally extends in a first plane. At least a portion of the first and second shelves extends in a second plane which is generally perpendicular to the first plane. The first and second shelves are separately transversely movable in the second plane relative to the frame. The shelf assembly is in an open position when the first and second shelves are transversely moved away and spaced apart from each other in the second plane, and a generally vacant space is formed between the first and second shelves. The shelf assembly is in a closed position when the first and second shelves are positioned proximate to each other.

In another embodiment, the present invention is directed to an adjustable shelf assembly including a first shelf member and a second shelf member attached to the frame. The first and second shelf members are in a first position when situated adjacent to each other, such that the first and second shelf members form a single shelf. The first and second shelf members are in a second position when transversely moved away from each other in the second plane, such that the first and second shelf members form first and second separate and spaced apart shelves. In the second position, a generally vacant space is formed between the first and second shelves. The generally vacant space is configured to support a flexible tube of a shower head assembly.

In yet another embodiment, the present invention is directed to an adjustable shelf assembly for removably mounting on a shower head assembly having a base, a head portion and a flexible tube connecting the base and the head portion. The adjustable shelf assembly includes an elongated frame, and first, second, third and fourth shelves attached to the frame. The frame generally extends in a first plane, and has a first end and a second end. The first end of the frame is removably mounted on the base of the shower head assembly. At least a portion of the first and second shelves extends in a second plane generally perpendicular to the first plane, and the first and second shelves are separately transversely movable in the second plane relative to the frame. At least a portion of the third and fourth shelves extends in a third plane generally parallel to and spaced beneath the second plane of the first and second shelves. The third and fourth shelves are separately transversely movable in the third plane relative to the frame. The shelf assembly is in a closed position when the first and second shelves are positioned proximate to each other in the second plane and the third and fourth shelves are positioned proximate to each other in the third plane. The shelf assembly is in an open position when the first and second shelves are transversely moved away and spaced apart from each other in the second plane and when the third and fourth shelves are transversely moved away and spaced apart from each other in the third plane. In the open position, a generally vacant space is formed between the first and second shelves and between the third and fourth shelves, and the flexible tube of the shower head assembly rests within the generally vacant space.

BRIEF DESCRIPTION OF THE SEVERAL VIEWS OF THE DRAWINGS

The following detailed description of the preferred embodiment of the present invention will be better understood when read in conjunction with the appended drawings. For the purposes of illustrating the invention, there are shown in the drawings an embodiment which is presently preferred. It is understood, however, that the invention is not limited to the precise arrangements and instrumentalities shown. In the drawings.

DETAILED DESCRIPTION OF THE INVENTION

Figure 1:
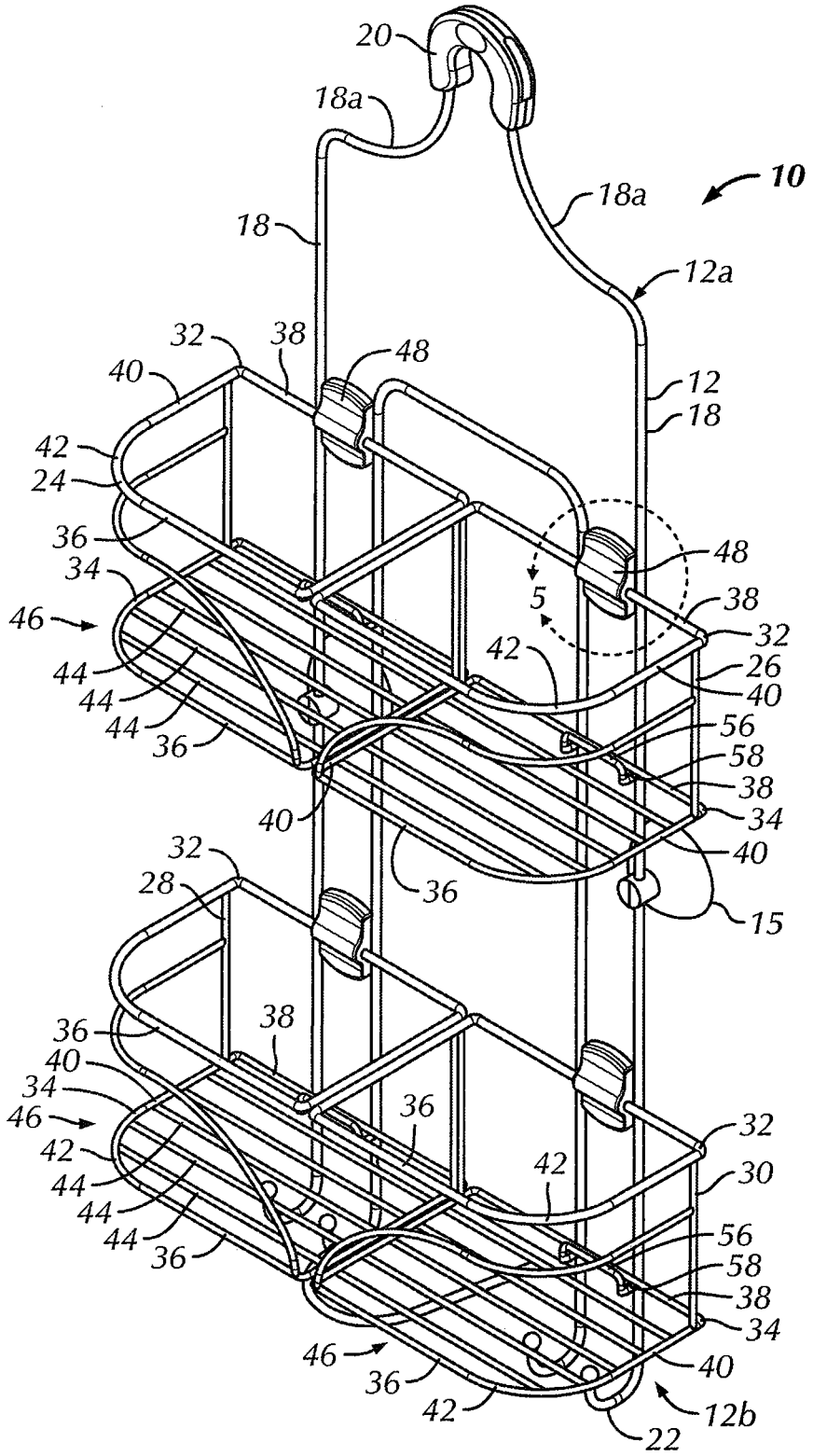
FIG. 1 is front perspective view of a preferred embodiment of an adjustable shelf assembly in accordance with the present invention, in a closed position.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the shower caddy and designated parts thereof. Unless specifically set forth herein, the terms "a", "an" and "the" are not limited to one element but instead should be read as meaning "at least one". The terminology includes the words noted above, derivatives thereof and words of similar import.

Referring to the drawings in detail, wherein like numerals and characters indicate like elements throughout, there is shown in FIGS. 1-10 a presently preferred embodiment of an adjustable shelf assembly in accordance with the present invention. With reference initially to FIGS. 1-4, the adjustable shelf assembly preferably functions as a shower caddy, generally designated 10.

Figure 2:
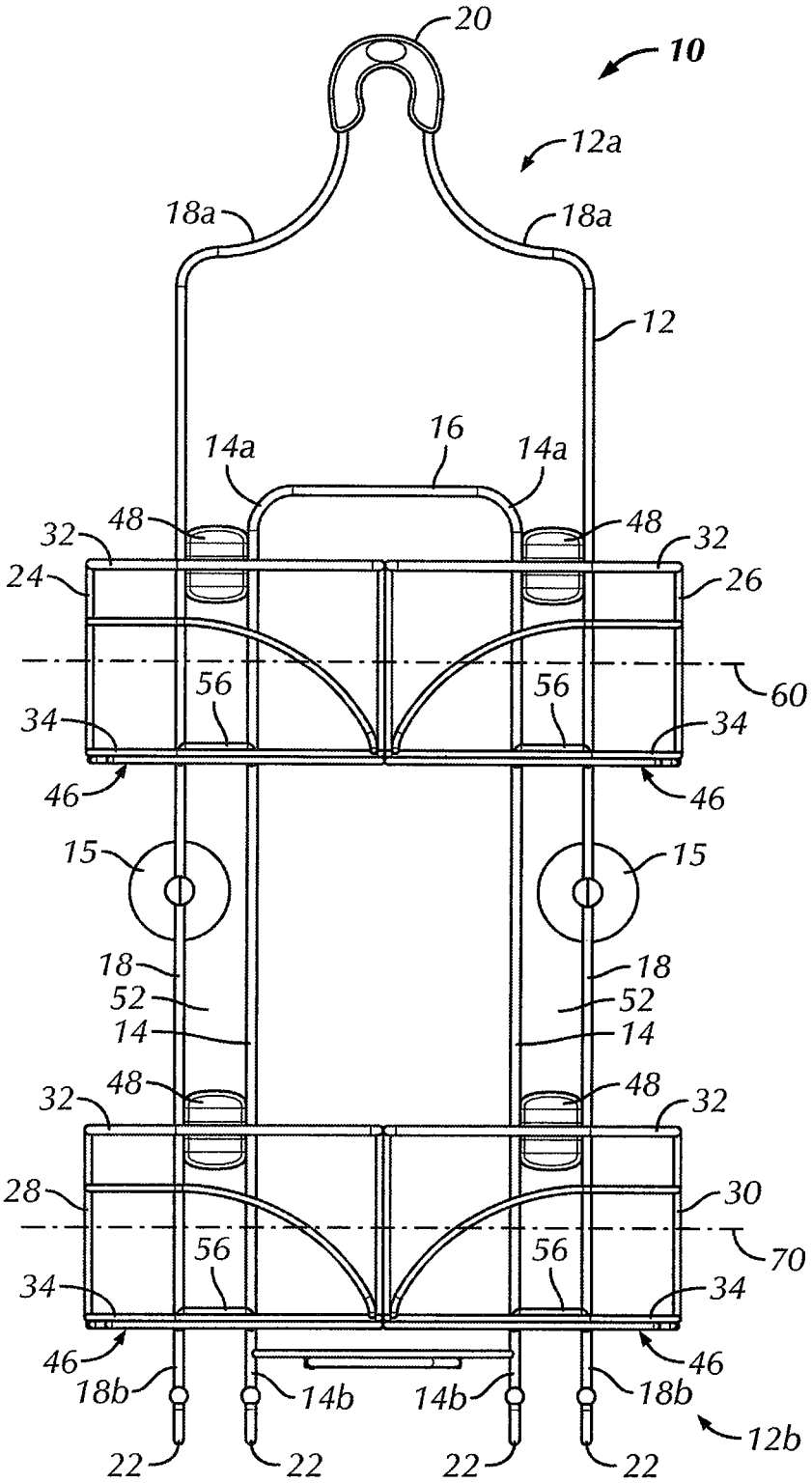
FIG. 2 is front elevational view of the adjustable shelf assembly of FIG. 1.

With particular reference to FIGS. 1-2, the shower caddy 10 comprises an elongated frame 12, preferably a metal wire frame 12, having a first or top end 12*a* and an opposing second or bottom end 12*b*. It will be appreciated that some suitable material, other than a metal material, may alternatively be used to form the frame 12. For example, the frame 12 may be formed of a polymeric material, a metal coated with a polymeric material or the like, or a combination of these materials. Referring to FIG. 2, the frame 12 generally extends in a first plane 50 which preferably corresponds to a vertical or longitudinal plane or axis. The frame 12 has a first pair of spaced-apart vertical bars 14 and a horizontal bar 16 extending across the vertical bars 14 at the upper ends 14*a* thereof. A second pair of vertical bars 18 are positioned adjacent to and outwardly (further to the right and left when viewed in FIG. 2) of the first pair of vertical bars 14. The second pair of vertical bars 18 extend generally parallel to the first pair of vertical bars 14. The second pair of vertical bars 18 transition into arcuately shaped portions 18*a* at their upper ends, and the arcuate portions 18*a* converge at the first or top end 12*a* of the frame 12 to form U-shaped mounting segment 20. Proximate the second or bottom end 12*b* of the frame 12, at least one of the distal ends 14*b*, 18*b* of the first and second pairs of vertical bars 14, 18 transitions into a curved hook 22. Preferably, each of the distal ends 14*b*, 18*b* of each of the first and second pairs of vertical bars 14, 18 are formed as curved hooks 22 at the bottom end 12*b* of the wire frame 12. Articles, such as loofas, may be removably mounted or hung on the hooks 22. The U-shaped segment 20 may be placed around a shower head assembly 100, so as to removably mount or suspend the shower caddy 10 from the shower head assembly 100 (see FIG. 10).

Referring to FIGS. 1-4, the shower caddy 10 further includes at least one securing member 15 which is attached to the frame 12 and is configured to detachably secure the shower caddy 10 to a separate structure. Preferably, the securing member comprises a suction cup 15 for detachably securing the shower caddy 10 to a wall. More preferably, the shower caddy 10 includes at least two suctions cups 15.

Referring to FIGS. 1-2, at least two shelves or shelf members are attached to the frame 12. Preferably, at least a first shelf 24 and a second shelf 26 are attached to the frame 12. More preferably, a third shelf 28 and a fourth shelf 30 are attached to the frame 12 and are positioned spaced apart from and beneath the first and second shelves 24, 26. Each of the shelves 24, 26, 28 and 30 has a basket-like configuration. Preferably, each shelf 24, 26, 28 and 30 includes an upper horizontally disposed planar frame section 32 and a lower horizontally disposed planar frame section 34. The upper and lower frame sections 32, 34 preferably have a generally rectangular or square shape. Specifically, the upper and lower frame sections 32, 34 preferably include front and rear elongated portions 36 and 38, respectively, which extend generally parallel to each other and generally perpendicular to the frame 12; first and second parallel elongated portions 40 extending across and generally perpendicular to the front and rear portions 36, 38; and a generally arcuate portion 42 extending therebetween. However, it will be understood by those skilled in the art that the upper and lower frame sections 32, 34 may have any appropriate shape, such as trapezoidal, elliptical or triangular, as long as the shelves are capable of holding one or more articles.

Accordingly, a portion of each shelf 24, 26, 28 and 30 and, more particularly, the upper and lower frame sections 32, 34 of each shelf 24, 26, 28 and 30 extend in planes which are generally perpendicular to the first plane 50. Specifically, the upper and lower frame sections 32, 34 of the first and second shelves 24, 26 extend in a second plane 60 which is generally perpendicular to the first plane 50. More particularly, the second plane 60 is a generally horizontal plane which extends generally transversely to the longitudinal, generally vertical first plane 50 of the frame 12. The upper and lower frame sections 32, 34 of the third and fourth shelves 28, 30 extend in a third plane 70. The third plane 70 is a generally horizontal plane which is generally parallel to the second plane 60 of the first and second shelves 24, 26, as well as generally perpendicular to the first plane 50 of the frame 12. The third plane 70 also extends generally transversely to the longitudinal, generally vertical first plane 50 of the frame 12. The third plane 70 of the third and fourth shelves 28, 30 is spaced apart from and beneath the second plane 60 of the first and second shelves 24, 26. The third and fourth shelves 28, 30 should be spaced a sufficient distance from and beneath the first and second shelves 24, 26 such that a user can easily access the third and fourth shelves 28, 30 for placing items in and removing items from the third and fourth shelves 28, 30.

Referring to FIG. 1, the lower frame sections 34 of each shelf 24, 26, 28 and 30 further include a plurality of spaced-apart generally horizontal bars 44 extending transversely across the lower frame sections 34. The plurality of spaced-apart horizontal bars 44, in conjunction with the lower frame section 34, form a horizontally-oriented support member 46 for each shelf 24, 26, 28 and 30, such that each shelf 24, 26, 28 and 30 is configured to support one or more articles, particularly bathing articles, such as soap, shampoo and/or conditioner. Because there are spaces between the plurality of horizontal bars 44, each horizontally-oriented support member 46 forms and functions as a drainage member.

Referring to FIGS. 1-2, each shelf 24, 26, 28 and 30 is mounted or attached to the frame 12 by a corresponding fastening element 48. Thus, for example, the first shelf 24 is attached to the frame 12 by a first fastening element 48 and the second shelf 26 is attached to the frame 12 by a second fastening element 48. Preferably, the fastening elements 48 are brackets 48. However, it will be understood by those skilled in the art that the caddy 10 may be equipped with any appropriate type of fastening element, such as clamp, clasp, or the like. Preferably, the brackets 48 are fixedly mounted to the frame 12, such that the brackets 48 are stationary relative to the frame 12. More preferably, the brackets 48 are fixedly positioned in the space 52 between the first and second pair of vertical bars 14, 18 of the frame 12.

Figure 5:
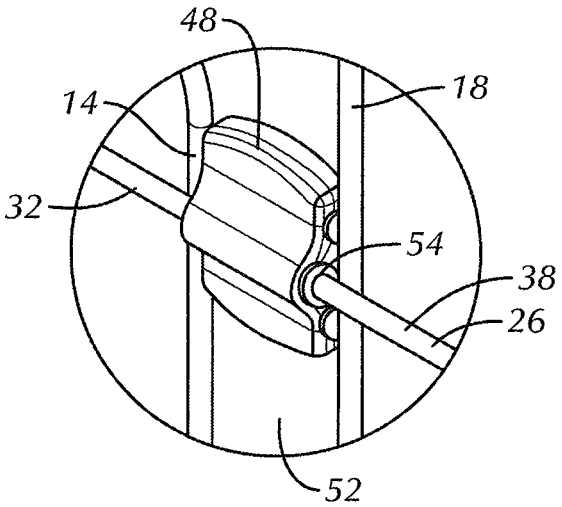
FIG. 5 is greatly enlarged front fragmentary view of a bracket of the adjustable shelf assembly shown in FIG. 1 taken about area 5 in FIG. 1.
Figure 6:
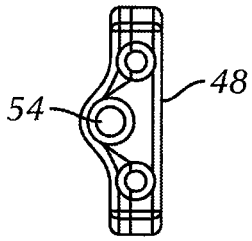
FIG. 6 is a right side elevational view of the bracket shown in FIG. 5.

Referring to FIGS. 1-2 and 5, the rear elongated portion 38 of the upper frame section 32 of each shelf 24, 26, 28 and 30 is attached to the frame 12 by a corresponding bracket 48. Referring to FIGS. 5-6, each bracket 48 includes a centrally disposed cylindrical channel 54 through which the rear elongated portion 38 can pass. More particularly, the channel 54 completely surrounds the rear elongated portion 38, and the diameter of the channel 54 is generally the same or slightly smaller than the diameter of the rear elongated portion 38 of each shelf 24, 26, 28 and 30, such that a friction fit is achieved between the rear elongated portion 38 of each shelf 24, 26, 28 and 30 and the channel 54 so the shelves 24, 26, 28, 30 will be held in place when not moving, but the fits still enables the rear elongated portion 38 of each shelf 24, 26, 28 and 30 to slide through the channel 54. Accordingly, each shelf 24, 26, 28 and 30 can move relative to the corresponding supporting bracket 48.

Figure 3:
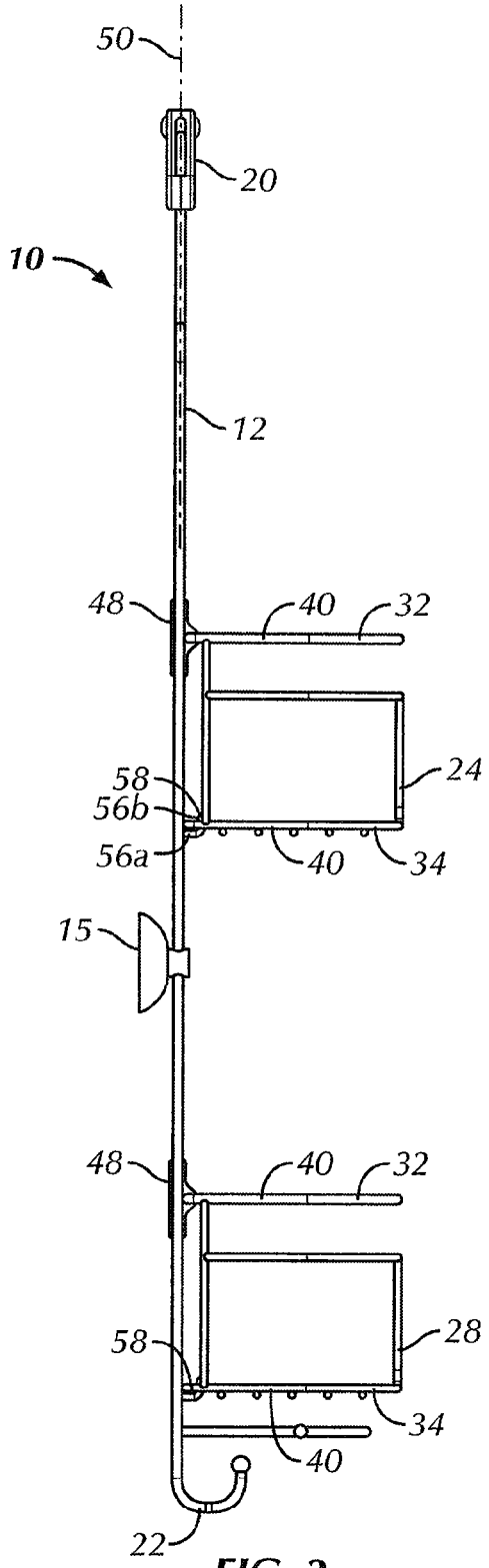
FIG. 3 is left side elevational view of the adjustable shelf assembly of FIG. 1.
Figure 4:
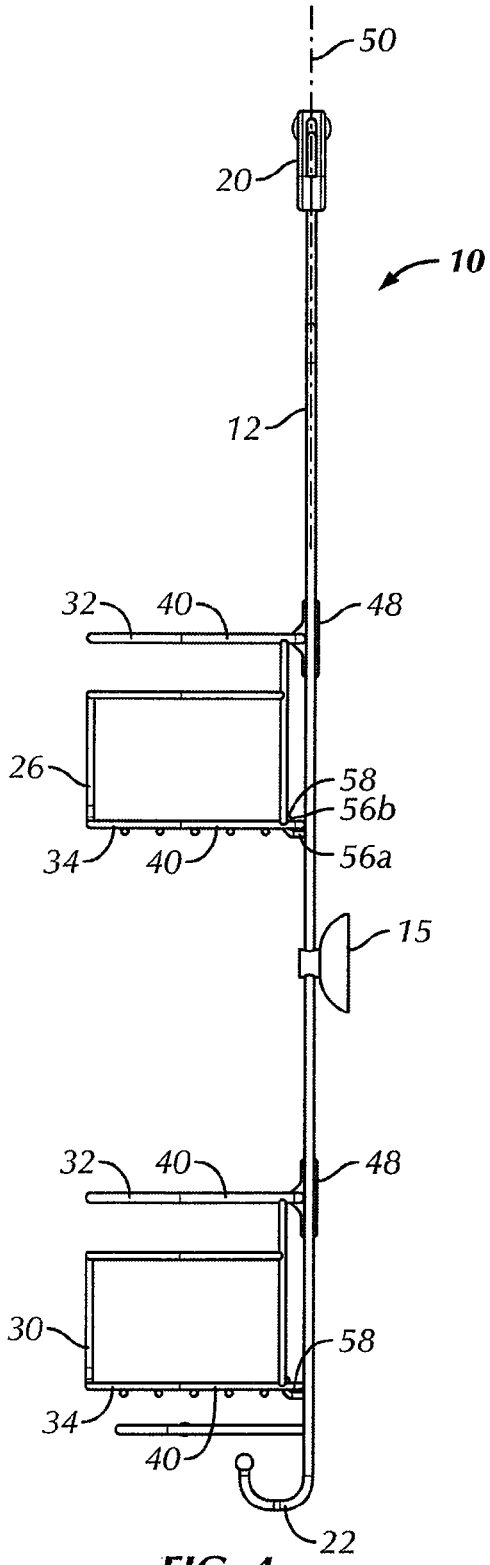
FIG. 4 is right side elevational view of the adjustable shelf assembly of FIG. 1.

Referring to FIGS. 1 and 3-4, the rear elongated portion 38 of the lower frame section 34 of each shelf 24, 26, 28 and 30 is attached to the frame 12 by a corresponding flange extension 56. Each flange extension 56 projects from the vertical bars 14, 18 of the frame 12. Each flange extension 56 is positioned at a location spaced apart from and beneath a corresponding bracket 48. Each flange extension 56 includes a first portion 56*a*, which extends generally horizontally and generally perpendicular to the vertical bars 14, 18, and a second portion 56*b*, which extends generally vertically and generally parallel to the vertical bars 14, 18. The first and second portions 56*a*, 56*b* are connected to each other and form a groove 58 which slidingly accommodates the rear elongated portion 38 of the lower frame section 34 of each shelf 24, 26, 28 and 30. Specifically, the rear elongated portion 38 of each shelf 24, 26, 28 and 30 is configured to rest within a corresponding groove 58 and is transversely movable relative to the flange extension 56 and the frame 12.

Accordingly, each of the first, second, third and fourth shelves 24, 26, 28 and 30 is permanently, but adjustably, attached to the frame 12. Each shelf 24, 26, 28 and 30 is horizontally movable or slidable relative to the brackets 48, flange extensions 56 and the frame 12. More particularly, each of the first and second shelves 24, 26 is transversely movable, separately or independently of each other, in the second plane 60 relative to the brackets 48 and the frame 12. Similarly, each of the third and fourth shelves 28, 30 is transversely movable, separately or independently of each other, in the third plane 70 relative to the brackets 48 and the frame 12.

In a closed or retracted position of the shower caddy 10, as shown in FIGS. 1-2, the first and second shelves 24, 26, are positioned proximate or adjacent to each other in the second plane 60. Preferably, in the closed position of the shower caddy 10, the third and fourth shelves 20, 22 are similarly positioned proximate or adjacent to each other in the third plane 70. More preferably, in the closed position of the shower caddy 10, a portion of the first and second shelves 24, 26, such as the upper and lower frame sections 32, 34, touch or contact each other, and a portion of the third and fourth shelves 28, 30, such as the upper and lower frame sections 32, 34, touch or contact each other. As such, in the closed position of the shower caddy 10, the first and second shelves 24, 26 may appear to form a unitary structure—i.e., a single upper shelf (see FIG. 2). The third and fourth shelves 28, 30 may similarly have a unitary appearance, that of a single lower shelf.

Figure 7:
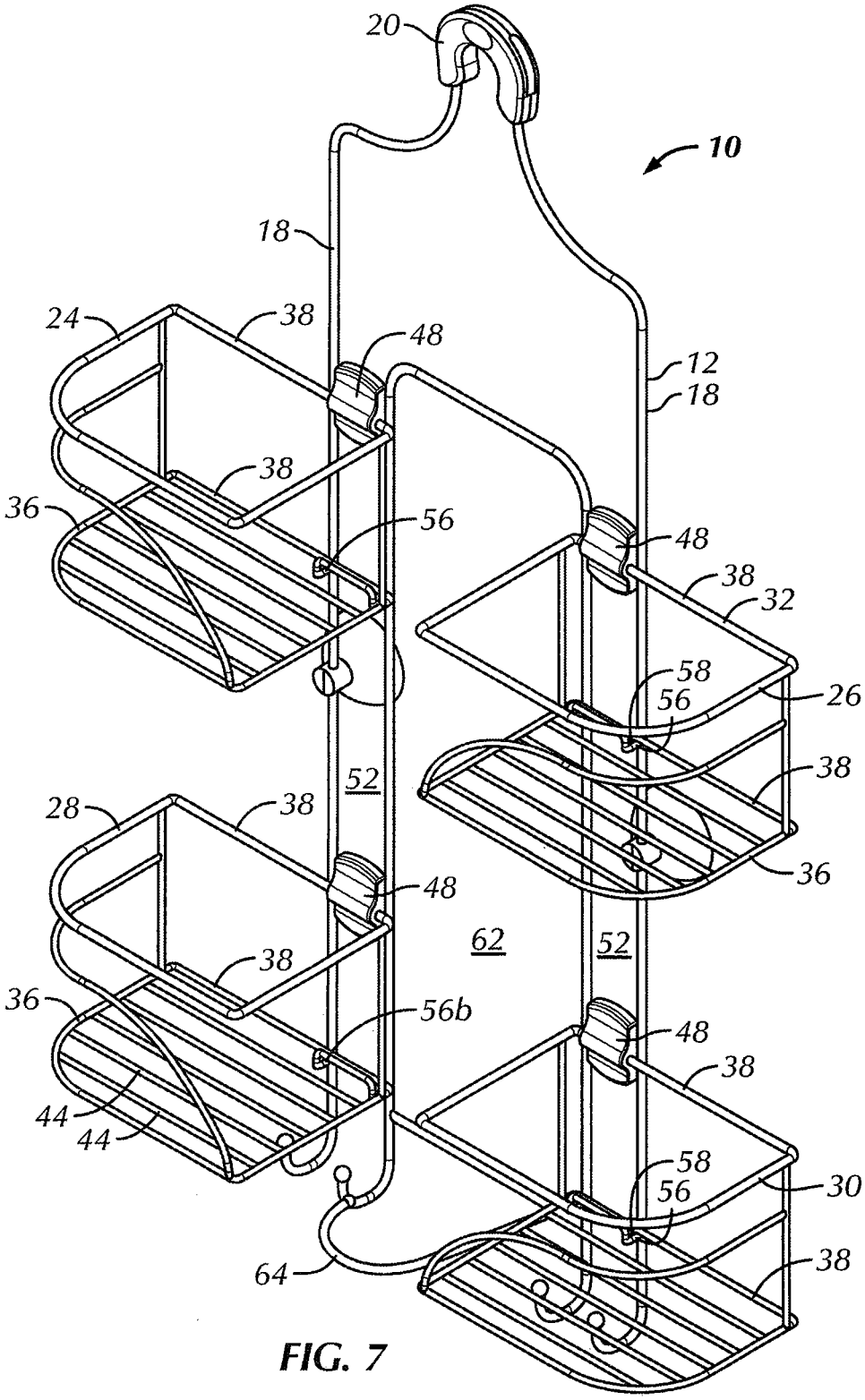
FIG. 7 is a front perspective view of the adjustable shelf assembly shown in FIG. 1 in an open position.
Figure 8:
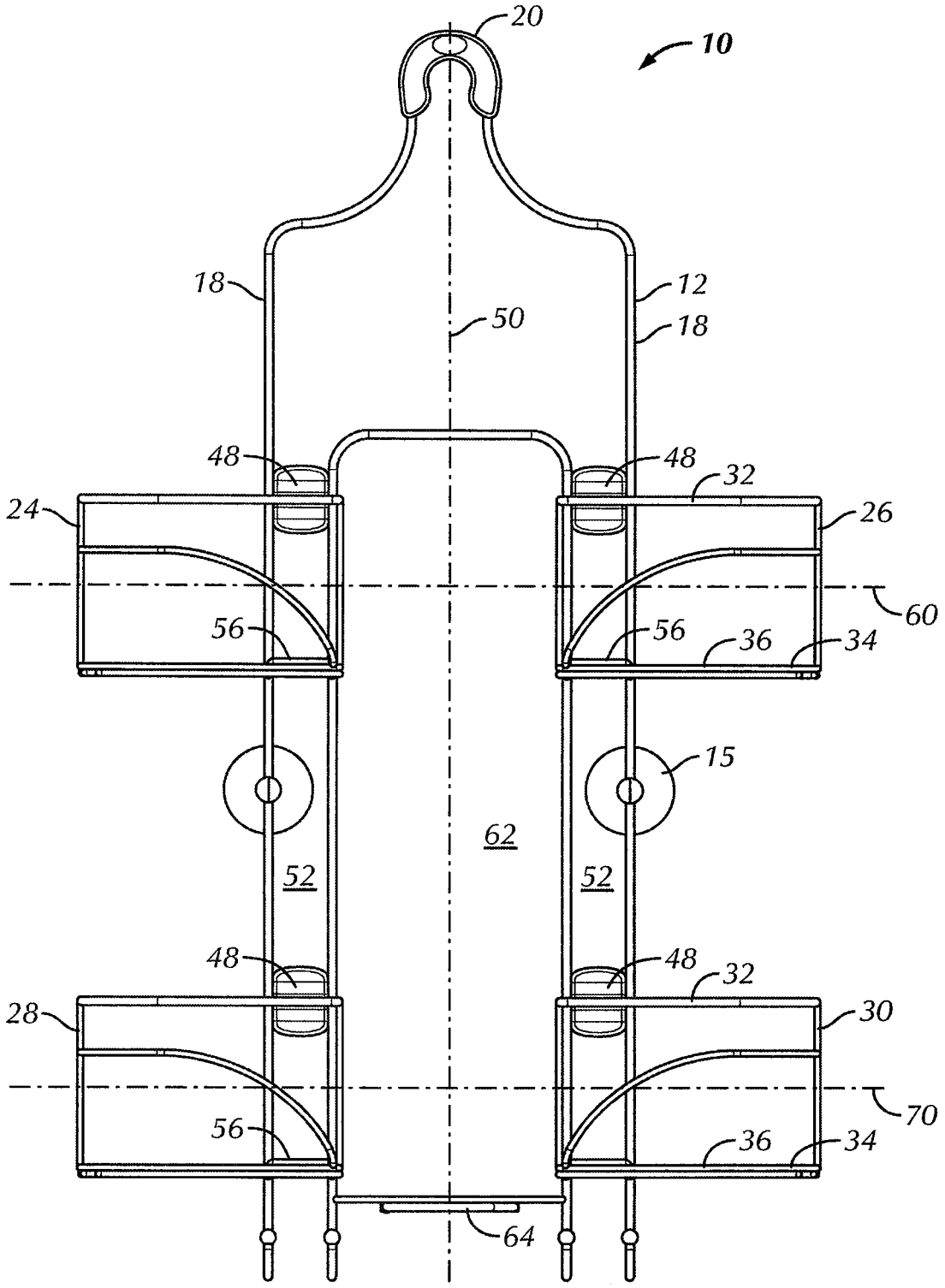
FIG. 8 is a front elevational view of the adjustable shelf assembly shown in FIG. 1 in the open position.
Figure 9:
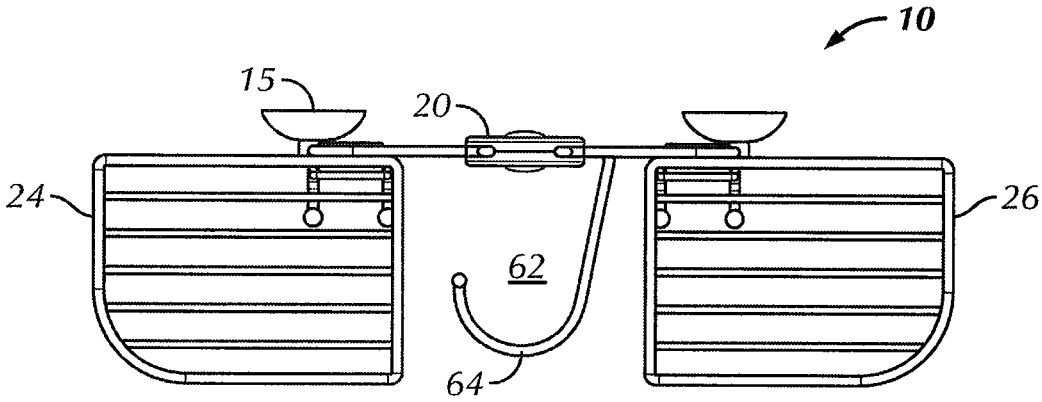
FIG. 9 is a top plan view of the adjustable shelf assembly shown in FIG. 1 in the open position.

Movement or sliding of the shelves 24, 26, 28 and 30 can place the shower caddy 10 in various configurations for use. In operation, each shelf 24, 26, 28 and 30 may be separately and independently positioned at any desired location on the frame 12 by moving or sliding one or more of the shelves 24, 26, 28 and 30, relative to the frame 12, via the corresponding bracket 48 and the corresponding groove 58. For example, by transversely moving or sliding the first and second shelves 24, 26 away from each other in the second plane 60, the shower caddy 10 is placed in an expanded or open position, as shown in FIGS. 7-8. Preferably, in the open position of the shower caddy 10, the third and fourth shelves 20, 22 are similarly transversely moved away from each other in the third plane 70 of the caddy 10. In the open position, the first and second shelves 24, 26 are spaced apart from each other in the second plane 60, and the third and fourth shelves 28, 30 are spaced apart from each other in the third plane 60. Accordingly, the shelves 24, 26, 28 and 30 serve as four separate and distinct shelf members. Referring to FIGS. 7-9, due to the expanded nature of the shower caddy 10 in the open position, a generally vacant or unoccupied space 62 is formed between the first and second shelves 24, 26, as well as between the third and fourth shelves 28, 30. More specifically, the unoccupied space 62 extends generally longitudinally along substantially an entire length of the frame 12 from the first end 12*a* to the second end 12*b*, and also extends generally transversely from the first shelf 24 toward the second shelf 26 and from the third shelf 28 toward the fourth shelf 30.

Figure 10:
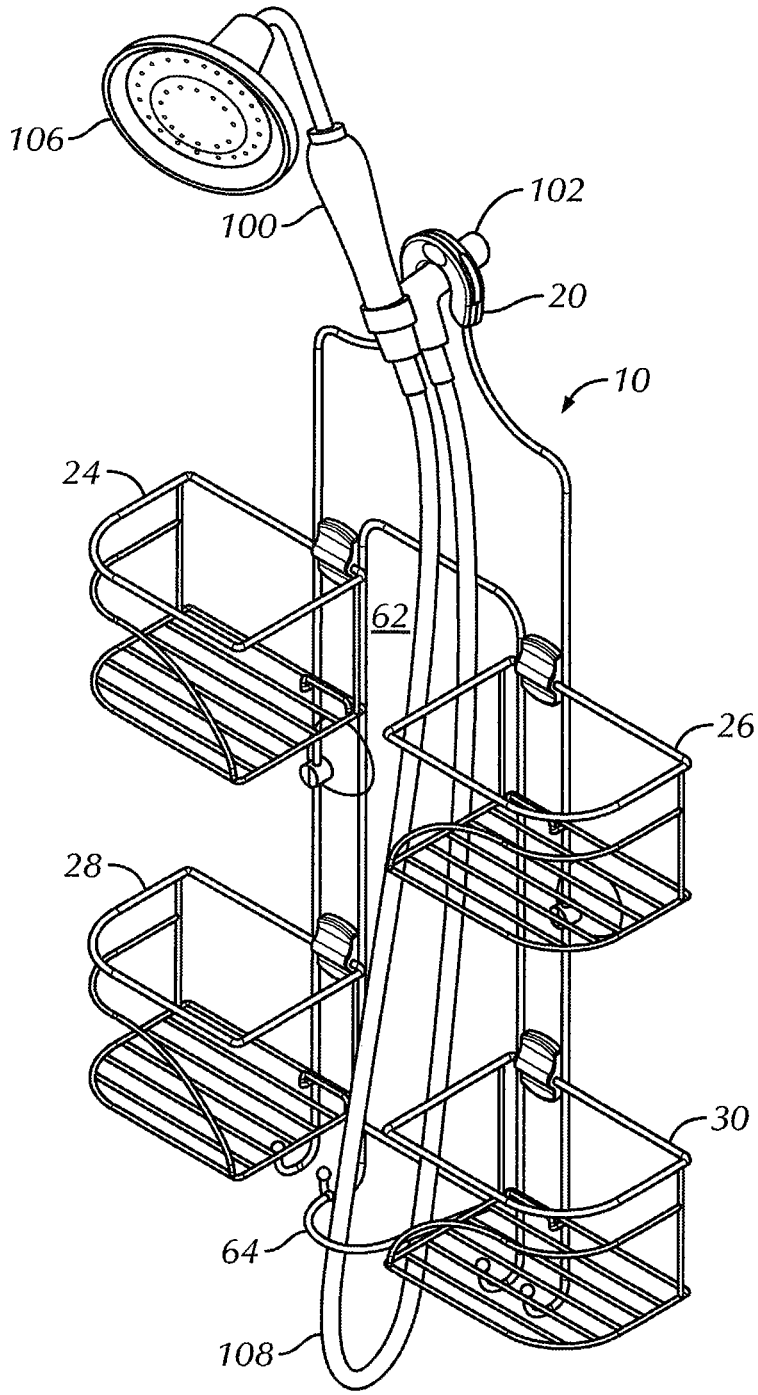
FIG. 10 is a front perspective view of the adjustable shelf assembly shown in FIG. 1 mounted on a shower head assembly in the open position.

As shown in FIG. 10, the shower caddy 10 is particularly beneficial for use with a shower head assembly including a flexible hose or tube. Specifically, referring to FIG. 10, the shower caddy 10 is configured to be removably mounted on the shower head assembly 100, which includes a base 102 that is mounted to a wall (e.g., a shower wall), a head portion 106 that is detachably mounted on the base 102, and a flexible tube or hose 108 which connects and extends between the head portion 106 and the base 102. When the shower caddy 10 is in the open position, the unoccupied space 62 between the shelves 24, 26, 28 and 30 is configured to support or accommodate the flexible tube 108 of the shower head assembly 100, such that the unoccupied space 62 provides a convenient area within which the flexible tube 108 may lie or rest. Accordingly, mounting of the caddy 10 is not obstructed by the hose 108, or vice versa.

The second or bottom end 12*b* of the shower caddy 10 is further equipped with a securing member 64. The securing member 64 is generally centrally located relatively to the frame 12. The securing member 64 extends from one of the first pair of vertical bars 14 of the frame 12 and has a curved, hook-like shape. Accordingly, the securing member 64 is configured to removably secure the flexible tube 108 of the shower head assembly 100 within the unoccupied space 62, either when the head portion 108 is connected to or detached from the base 102.

From this disclosure, one of ordinary skill in the art would recognize that other conventional materials and fabrication techniques could be substituted. Also based on this disclosure, a person of ordinary skill in the art would further recognize that the relative proportions of the components illustrated could be varied without departing from the spirit and scope of the invention.

It will be appreciated by those skilled in the art that changes could be made to the above described preferred embodiment 10 of the shower caddy without departing from the broad inventive concepts thereof. It is understood, therefore, that this invention is not limited to the particular embodiment disclosed, but is intended to cover modifications within the spirit and scope of the present invention as defined by the appended claims.

We claim:

1. A combination of an adjustable shelf assembly and a shower head assembly, the adjustable shelf assembly being configured to be removably mountable on the shower head assembly, the shower head assembly having a base, a head portion and a flexible tube connecting the base and the head portion, the adjustable shelf assembly comprising:

an elongated frame generally extending in a first plane and having a first end and a second end, the first end of the frame being removably mounted on the base of the shower head assembly;

a first shelf attached to the frame by a first fastening element and a second shelf attached to the frame by a second fastening element, the first and second fastening elements being positioned between respective first and second pairs of vertical bars of the frame and at least a portion of each of the first and second fastening elements extending in the first plane, at least a portion of the first and second shelves extending in a second plane generally perpendicular to the first plane, the first and second shelves being separately transversely movable in the second plane relative to the frame; and a third and a fourth shelf attached to the frame, at least a portion of the third and fourth shelves extending in a third plane generally parallel to and spaced beneath the second plane of the first and second shelves, the third and fourth shelves being separately transversely movable in the third plane relative to the frame, wherein the shelf assembly is in a closed position when the first and second shelves are positioned proximate to each other in the second plane and the third and fourth shelves are positioned proximate to each other in the third plane, and wherein the shelf assembly is in an open position when the first and second shelves are transversely moved away and spaced apart from each other in the second plane and when the third and fourth shelves are transversely moved away and spaced apart from each other in the third plane, such that a generally vacant space is formed between the first and second shelves and between the third and fourth shelves, and the flexible tube of the shower head assembly rests within the generally vacant space.

2. The combination of an adjustable shelf assembly and a shower head assembly of claim 1, wherein the first and second shelves contact each other and the third and fourth shelves contact each other in the closed position of the assembly.

3. The combination of an adjustable shelf assembly and a shower head assembly of claim 1, further comprising a centrally located securing member at the second end of the frame to removably secure the flexible tube of the shower assembly within the generally vacant space.

4. The combination of an adjustable shelf assembly and a shower head assembly of claim 1, further comprising at least one hook at the second end of the frame.

5. The combination of an adjustable shelf assembly and a shower head assembly of claim 1, wherein each of the shelves is attached to the frame by a fastening element, the fastening elements being stationary relative to the frame and the shelves being separately movable relative to the fastening elements.

* * * * *